US009204670B2

(12) United States Patent
Liu

(10) Patent No.: US 9,204,670 B2
(45) Date of Patent: Dec. 8, 2015

(54) ELECTRONIC CIGARETTE ATOMIZATION DEVICE

(75) Inventor: Qiuming Liu, Guangdong (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 869 days.

(21) Appl. No.: 13/511,545

(22) PCT Filed: Apr. 9, 2010

(86) PCT No.: PCT/CN2010/071665

§ 371 (c)(1),
(2), (4) Date: May 23, 2012

(87) PCT Pub. No.: WO2011/124033

PCT Pub. Date: Oct. 13, 2011

(65) Prior Publication Data

US 2012/0285475 A1 Nov. 15, 2012

(51) Int. Cl.
*A24F 47/00* (2006.01)

(52) U.S. Cl.
CPC ..... *A24F 47/008* (2013.01)

(58) Field of Classification Search
CPC . A24F 47/008; A61M 11/042; A61M 11/044; A61M 15/06
See application file for complete search history.

(56) References Cited

U.S. PATENT DOCUMENTS 4,068,672 A * 1/1978 Guerra ..... A24F 47/00 131/178
4,922,901 A * 5/1990 Brooks ..... A24F 47/006 128/202.27
4,947,875 A * 8/1990 Brooks ..... A24F 47/006 128/202.21
5,093,894 A * 3/1992 Deevi ..... A24F 47/008 392/390
5,144,962 A * 9/1992 Counts ..... A24F 47/008 128/200.14
5,224,498 A * 7/1993 Deevi ..... A24F 47/008 128/202.21
5,353,813 A * 10/1994 Deevi ..... A24F 47/008 131/194
5,408,574 A * 4/1995 Deevi ..... A24F 47/008 128/202.21
5,468,936 A * 11/1995 Deevi ..... H05B 3/141 319/543
7,494,344 B2 * 2/2009 Galauner ..... A61M 11/041 439/67
7,513,781 B2 * 4/2009 Galauner ..... A61M 11/041 439/509
7,540,286 B2 * 6/2009 Cross ..... A61M 15/0045 128/203.26
8,857,446 B2 * 10/2014 Wu ..... 131/273

(Continued)

FOREIGN PATENT DOCUMENTS

CN 101228969 A 7/2008
CN 201104488 Y 8/2008

(Continued)

*Primary Examiner* — Jason L Lazorcik
(74) *Attorney, Agent, or Firm* — Tim Tingkang Xia, Esq.; Locke Lord LLP

(57) ABSTRACT

An electronic cigarette atomization device is built in a disposable electronic cigarette or disposable smoke capsule electronic cigarette. The electronic cigarette atomization device comprises a tar storage (2) between the smoke capsule shell (4) of the electronic cigarette and a hollow tubular bracket (3), a smoking channel corresponding to the hollow tubular bracket (3), and a heating element (5) electrically connected to a battery (10) of the electronic cigarette at outlet of the tar storage in the channel. The heating element (5) and the axis of the hollow tubular bracket (3) form an angle of 10-90°, connection wires (8) at two ends of the heating element (5) are provided between the hollow tubular bracket (3) and the smoke capsule shell (4), electrically connected to the battery (10).

5 Claims, 3 Drawing Sheets

(56) References Cited

U.S. PATENT DOCUMENTS

| | | | | |
|---|---|---|---|---|
| 8,897,628 | B2 * | 11/2014 | Conley | A61M 11/042 392/386 |
| 8,910,640 | B2 * | 12/2014 | Sears | F22B 1/28 128/202.21 |
| 2005/0117895 | A1 * | 6/2005 | Balch | A61M 11/041 392/386 |
| 2009/0095311 | A1 * | 4/2009 | Han | A24F 47/008 131/194 |
| 2009/0188490 | A1 * | 7/2009 | Han | A61M 11/041 128/200.14 |
| 2011/0011396 | A1 * | 1/2011 | Fang | A61M 15/06 128/202.21 |
| 2011/0155718 | A1 * | 6/2011 | Greim | F24H 1/0018 219/507 |
| 2011/0303231 | A1 * | 12/2011 | Li | A24F 47/008 131/329 |
| 2012/0145169 | A1 * | 6/2012 | Wu | A24F 47/008 131/273 |
| 2012/0260927 | A1 * | 10/2012 | Liu | A24F 47/008 131/329 |
| 2013/0192617 | A1 * | 8/2013 | Thompson | A24F 47/008 131/329 |
| 2013/0192623 | A1 * | 8/2013 | Tucker | H01C 17/00 131/329 |
| 2013/0228191 | A1 * | 9/2013 | Newton | A24F 47/008 131/329 |
| 2013/0319436 | A1 * | 12/2013 | Liu | A24F 47/008 131/329 |
| 2014/0290674 | A1 * | 10/2014 | Liu | A24F 47/008 131/329 |

FOREIGN PATENT DOCUMENTS

| | | | |
|---|---|---|---|
| CN | 201238610 | Y | 5/2009 |
| CN | 101606758 | A | 12/2009 |
| WO | 2008077271 | A1 | 7/2008 |
| WO | 2008130813 | A1 | 10/2008 |

* cited by examiner

ELECTRONIC CIGARETTE ATOMIZATION DEVICE

FIELD OF THE INVENTION

The present invention relates to an electronic cigarette, specifically relates to an atomization device applied to a disposable smoke capsule electronic cigarette and a disposable electronic cigarette.

BACKGROUND OF THE INVENTION

Electronic cigarette is a cigarette electronic simulation product, mainly comprising tar, an atomization device and a battery. On the market, there are mainly three kinds of electronic cigarettes: an ordinary electronic cigarette, a disposable smoke capsule electronic cigarette and a disposable electronic cigarette. Wherein, for the ordinary electronic cigarette, the tar storage device and the atomization device are separated, after the tar is used out, only the tar storage device should be thrown away. For the disposable smoke capsule electronic cigarette, a tar storage device and an atomization device are integrated together, after the tar is used out, the tar storage device as well as the atomization device should be thrown away. For the disposable electronic cigarette, a tar storage device, an atomization device and a battery are integrated together, after the tar is used out, all of them should be thrown away. Different from the ordinary electronic cigarette, the disposable smoke capsule electronic cigarette or the disposable electronic cigarette apply disposable electronic smoke atomizer technology.

In the ordinary electronic cigarette, the tar storage device (tar storage capsule for short) and the atomization device are separated. As such, the atomization device is reusable. After finishing one, only the tar storage capsule is needed to be replaced. As shown in FIG. 1, the atomization device of the ordinary electronic cigarette comprises a spiral heating resistance wire 5 as well as a tar guiding system which is composed of a tar guiding fiber 6 and a tar guiding foam nickel 11. The heating resistance wire 5 which is provided laterally in the hollow shell is connected respectively with a pilot switch 9 and a battery 10 both of which are in the cigarette body. As shown in FIGS. 2-1 and 2-2, in the disposable smoke capsule electronic cigarette, the atomization device and the tar storage device are integrated together. The atomization device comprises a cigarette holder 1 with suction holes, a smoke capsule shell 4, a tar storage fiber 2, a hollow tubular bracket 3 separated into two vertically, a heating resistance wire 5 located vertically in the middle, a tar guiding fiber 6, a connecting piece 7 and an electronic wire 8. The working principle is: the electronic tar stored inside the tar storage fiber enters into the spiral heating resistance wire 5 though the tar guiding fiber 6. During smoking, turn on the pilot switch inside or on the cigarette body 12, then the resistance wire 5 is conducted with the battery 10 in the cigarette body 12 via the electronic wire 8 and the connecting piece 7. When the resistance wire 5 starts to work, with air flowing into the hollow tubular bracket 3, the smoke produced by the tar being vaporized by the heating resistance wire 5. The smoke is inhaled into people's mouth by the suction holes of the cigarette holder 1, so as to achieve the smoking effect. The connecting piece 7 is connected with the cigarette body 12 by a screw thread, a headphones plug or a concavo convex plug, and also connected with the battery 10 therein. The only difference between FIG. 2-1 and FIG. 2-2 is the connection of the electronic wire 8. However, in the two cases, for point ((1)), the resistance wires 5 are both vertically set; and for point ((2)), one end of the electronic wire 8 are both connected to connecting piece 7 though the hollow tubular bracket 3, combining ((1)) and ((2)) (((1))+((2))) to bring out: vertically setting way.

At present, all electronic cigarette plants are trying to make smoke capsule have large storage space as far as possible, and all the heating resistance wire are made with the same material. If the heating resistance wire is vertically rather than horizontally arranged inside the smoke capsule, it will save space for twining cotton thread. As a result, more tar-storage fiber may be twined. That's why the heating resistance wire 5 is vertically arranged, the hollow tubular bracket is separated and the hollow tubular is in small size. The flowing are the defeats corresponding to this kind of disposable electronic cigarette atomization device.

A. Due to the misalignment produced in assembling, the hollow tubular is easily to be plugged which can lead to tar leaking, breathlessness during smoking and so on, because the hollow tubular bracket is separated. In addition, as the heating resistance wire 5 is not wrapped by the hollow tubular bracket, the produced heat can make the smoke capsule shell very hot at once.

B. The atomization component comprised of the heating resistance wire 5 and the tar guiding fiber 6 is vertically arranged in the hollow tubular bracket. In such case, because of up-down asymmetry, the tar guided from the tar guiding fiber is consequently nonuniform. As a result, the amount of smoke during the whole smoking process is nonuniform. Besides, when in mass production, once the vertically arranged atomization component become askew, the ventilation will be affected and can easily lead to breathlessness, tar leaking.

C. The hollow tubular bracket in small size can easily result in tar leaking and heat-dissipating problem.

DISCLOSURE OF THE INVENTION

The Technical Problems

The purpose of the invention, which provides a disposable electronic cigarette atomization device, is to overcome the defects in the prior art, so as to realize one or more of the following items: increasing the amount of smoke, smoking uniformly, simplifying the manufacture process, decreasing the happens of breathlessness, avoiding tar leaking and heating.

The Technical Solutions

The purpose of the invention can be reached by utilizing the means as followed.

The electronic cigarette atomization device is built in a disposable electronic cigarette or a disposable smoke capsule electronic cigarette. The electronic cigarette atomization device comprises a tar storage between the smoke capsule shell of the electronic cigarette and a hollow tubular bracket, a smoking channel corresponding to the hollow tubular bracket, and a heating element electrically connected to a battery of the electronic cigarette at outlet of the tar storage in the channel. wherein, ((1))' the heating element and the axis of the hollow tubular bracket form an angle of 10-90°; ((2))' the connection wires at tow ends of the heating element are provided between the hollow tubular bracket and the smoke capsule shell, electronically connected to the battery. Wherein, the connection wire may be connected to the battery internally as a whole, or the connection wire may be connected to the battery externally through the smoke capsule and the cigarette body. Combining ((1))' and ((2))' may bring out: obliquely setting way. In such case, the amount of smoke is larger, smoking is more uniform, and the heat-dissipating performance is better.

The purpose of the invention also could be reached by utilizing the means as followed.

The heating element and the axis of hollow tubular bracket form an angle of 30-90°, while 90° is preferred. That is, with horizontally arrangement, the angle can also be 35°, 40°, 45°, 50°, 55°, 60°, 65°, 70°, 75°, 80°, 85°. Especially for 90° with horizontally arrangement, there is nearly no filtered smoke and the device can dissipate heat very well.

The hollow tubular bracket comprises an upper and a lower hollow tubular bracket which two are coaxial, and between which is provided the heating element. Though it is a traditional craft of the disposable electronic cigarette, the obliquely/horizontally arrangement is utilized.

The hollow tubular bracket is an integral hollow tubular bracket and the heating element passes through the integral hollow tubular bracket. In the new way, manufacture difficulty is reduced.

The hollow tubular bracket can either be a round pipe with diameter larger than or equal to 3 mm; or have a cross section of ellipse, square, polygon or quincunx with dimensions larger than 7 $mm^2$. As the hollow tubular bracket has a larger diameter, the output smoke is more sufficient. In addition, as smoking is more uniform in the invention, it is easy for the user to inhale smoke without tar leaking.

The heating element comprises but not limited to resistance wire, thermal sensitive ceramic or silicon carbide rod.

The resistance wire is spiral, in the center of which there is nonmetallic tar guiding fiber with two ends connected with the tar storage. The performance is good. The heating element may be a flat component on the surface of which is provided the nonmetallic tar guiding fiber connected with the tar storage. Nonmetallic tar guiding fiber is non-conducting.

Beneficial Effects

Compared with the prior art, the invention has the beneficial effects as followed:

A. The integral hollow tubular bracket is easy to manufacture and can avoid the problems induced by disalignment in assembling, the problems comprising blocking, tar leaking, breathlessness during smoking and so on. In addition, as most of the heating resistance wire 5 hanging in the air is wrapped by hollow tubular bracket, and the air conducts heat slowly while dissipates heat quickly—the heat is dissipated though circulation channel, it's hard to make smoke capsule shell hot.

B. The atomization component, which lies laterally in the hollow tubular bracket, is composed of the resistance wire 5 and the tar guiding fiber 6. Because of this kind of up-down symmetry, the tar outflowing form the tar guiding fiber is uniform and fully atomized without being filtered. So it is not easy to produce breathlessness, tar leaking.

C. The hollow tubular bracket 3 is big enough to avoid tar leaking and heat-dissipating problem.

DESCRIPTION OF FIGURES

FIG. 2-1 shows a structural representation of a traditional disposable electronic cigarette atomization device;

FIG. 2-2 shows a structural representation of another traditional disposable electronic cigarette atomization device;

FIGS. 4-1, 4-2, 4-3 and 4-4 respectively show the cross sections of the hollow tubular bracket in the disposable electronic cigarette atomization device according to the four embodiments of the present invention.

THE PREFERRED EMBODIMENTS OF THE INVENTION

Figure 1:
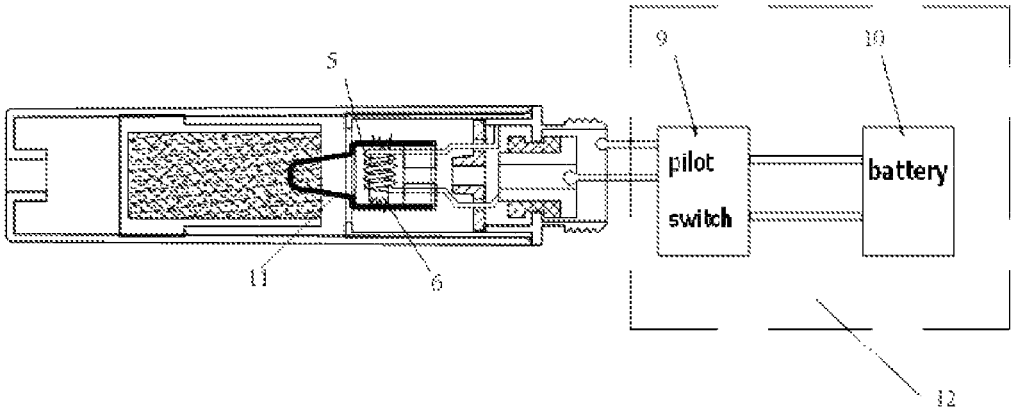
FIG. 1 shows a structural representation of traditional ordinary electronic cigarette atomization device.
Figures 1, 2:
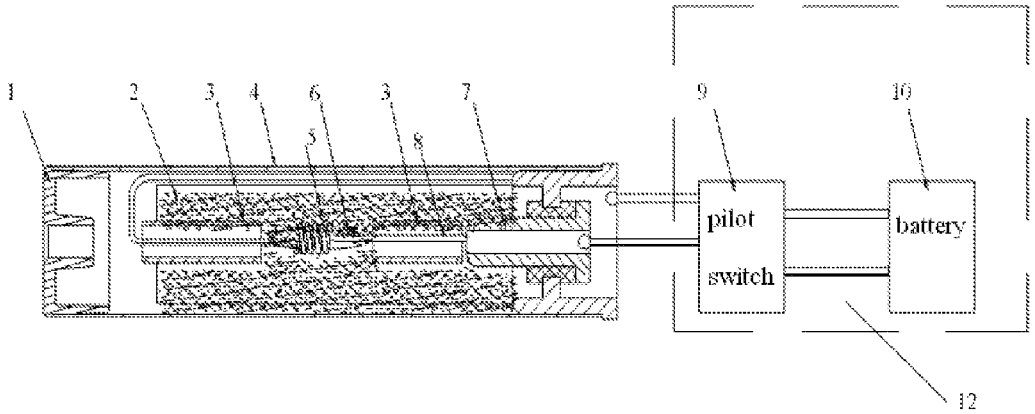
Figure 2:
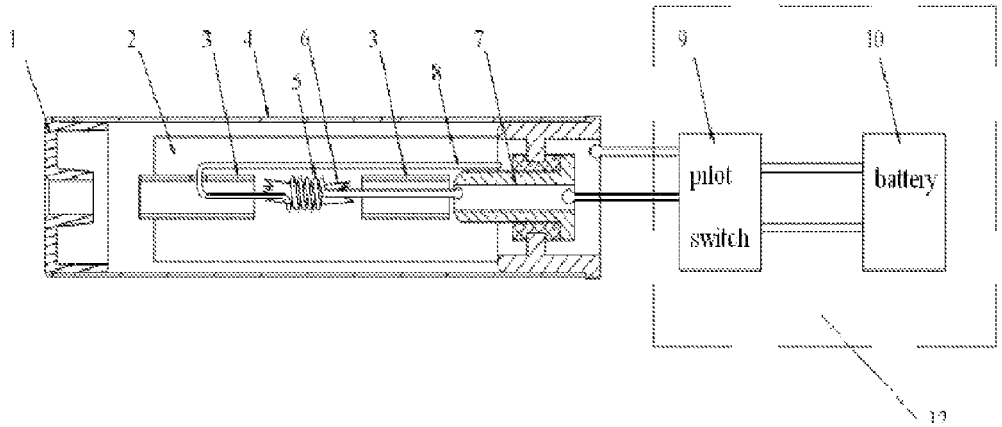
Figure 3:
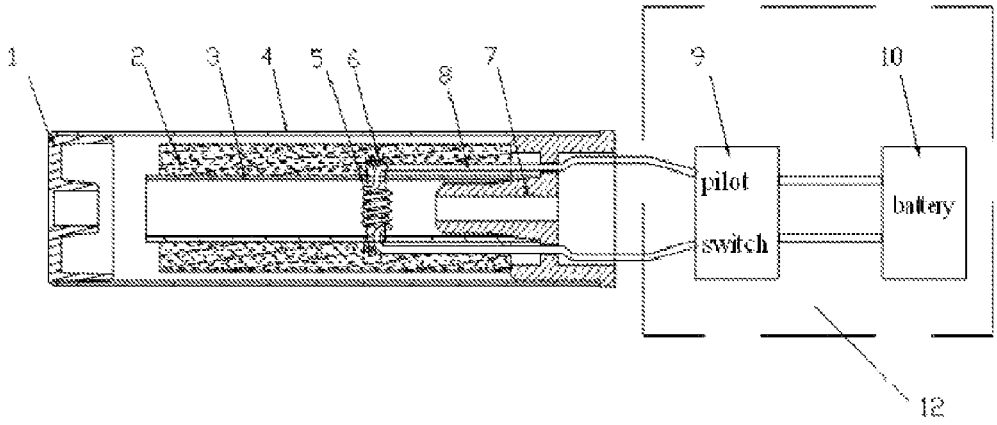
FIG. 3 shows a structural representation of a disposable electronic cigarette atomization device in this invention.
Figures 1, 4:
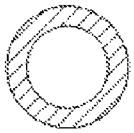
Figures 2, 4:
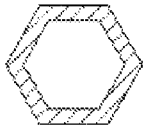
Figures 3, 4:
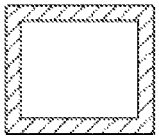
Figure 4:
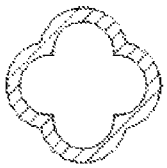

The preferred embodiment of the invention is applied to a disposable smoke capsule electronic cigarette. As shown in FIG. 3, the disposable smoke capsule electronic cigarette comprises a cigarette holder 1, a tar-storage fiber 2 (as the tar storage), a hollow tubular bracket 3, a smoke capsule shell 4, a spiral heating resistance wire 5, a tar guiding fiber 6, a connecting piece 7, a electronic connection wires 8 which is connected with a pilot switch 9 and a battery 10 both of which are inside the cigarette body 12. The main characteristics are shown as followed.

1. The atomization component, which lies laterally in the hollow tubular bracket and forms an angle of 90° with the axis of the hollow tubular bracket, comprises the resistance wire 5 and the tar guiding fiber 6. And the electronic connection wires 8 of the atomization component passes though the space between the smoke capsule shell 4 and the hollow tubular bracket.

2. The hollow tubular bracket 3 is made as a whole. The electronic connection wires 8 passes a hole provided on the hollow tubular bracket, ant then is connected with the heating resistance wire 5. Or the heating resistance wire 5 passes a hole provided on the hollow tubular bracket, ant then is connected with the electronic connection wires 8. In the later case, all or most of the heating resistance wire 5 is wrapped by the hollow tubular bracket 3. And the later is preferred.

3. The size of the hollow tubular bracket 3 is large enough, with a diameter of the cross section greater than or equal to 3 mm (for the shape of the cross section is circular), or with a cross section area greater than 7 $mm^2$ (for the shape of the cross section is non-circular).

The disposable cigarette holder can be mechanically connected with the reusable cigarette body 12 via the connecting piece 7 by means of screw thread, concavo convex plug an so on and. And the disposable cigarette holder also can be electronically connected with the pilot switch inside the cigarette body 12. As a result, the battery 10, the pilot switch 9 and the heating resistance wire 5 form an effective function body.

The shape of the cross section of the hollow tubular bracket 3 can be ellipse, square, polygon or quincunx and so on.

THE EMBODIMENTS OF THE INVENTION

The Industrial Applicability

The present invention atomization device is applicable to a disposable electronic cigarette or a disposable smoke capsule electronic cigarette, and can effectively reduce the product cost and improve the product quality and safety. As a result, it is beneficial to the further application of the disposable electronic cigarette, and makes lots of smokers receive pleasure from non-toxic smoking at low cost.

The invention claimed is:

1. An electronic cigarette atomization device built in a disposable electronic cigarette or a disposable smoke capsule electronic cigarette, comprising a tar storage between a smoke capsule shell (4) of the electronic cigarette and a hollow tubular bracket (3), a smoking channel corresponding to the hollow tubular bracket, and a heating element electrically connected to a battery (10) of the electronic cigarette at outlet of the tar storage in the channel;

wherein, the heating element and an axis of the hollow tubular bracket form an angle of 10-90°, connection wires (8) at two ends of the heating elements are provided between the hollow tubular bracket and the smoke capsule shell (4), connected to the battery;

wherein, the hollow tubular bracket (3) comprises an upper and a lower hollow tubular brackets which are coaxial, and the heating element is provided between the upper and lower hollow tubular brackets;

wherein, cross-sectional area of the hollow tubular bracket (3) is greater than 7 mm2;

wherein, the heating element is thermal sensitive ceramic; and wherein, the heating element is a flat component, and the nonmetallic tar guiding fiber connected to the tar storage is provided on a surface of the flat component.

2. The electronic cigarette atomization device of claim 1, wherein, the heating element and the axis of the hollow tubular bracket form an angle of 30-90°.

3. The electronic cigarette atomization device of claim 1, wherein, the heating element and the axis of the hollow tubular bracket form an angle of 90°.

4. The electronic cigarette atomization device of claim 1, wherein, the hollow tubular bracket (3) is a round pipe with a diameter greater than or equal to 3 mm.

5. The electronic cigarette atomization device of claim 1, wherein, the shape of the cross section of the hollow tubular bracket (3) is ellipse, square, polygon or quincunx.

* * * * *